US008306824B2

(12) United States Patent
Park

(10) Patent No.: US 8,306,824 B2
(45) Date of Patent: Nov. 6, 2012

(54) METHOD AND APPARATUS FOR CREATING FACE CHARACTER BASED ON VOICE

(75) Inventor: Bong-cheol Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 592 days.

(21) Appl. No.: 12/548,178

(22) Filed: Aug. 26, 2009

(65) Prior Publication Data

US 2010/0094634 A1 Apr. 15, 2010

(30) Foreign Application Priority Data

Oct. 14, 2008 (KR) ..... 10-2008-0100838

(51) Int. Cl.
*G10L 21/00* (2006.01)

(52) U.S. Cl. ..... 704/270; 704/272; 704/275; 704/276

(58) Field of Classification Search ..... 704/270, 704/272, 275, 276
See application file for complete search history.

(56) References Cited

U.S. PATENT DOCUMENTS

| | | | | |
|---|---|---|---|---|
| 6,665,643 | B1 | 12/2003 | Lande et al. | |
| 6,735,566 | B1 | 5/2004 | Brand | |
| 7,426,287 | B2 | 9/2008 | Yoon et al. | |
| 2002/0097380 | A1 * | 7/2002 | Moulton et al. | 352/5 |
| 2003/0163315 | A1 * | 8/2003 | Challapali et al. | 704/260 |
| 2004/0207720 | A1 | 10/2004 | Miyahara et al. | |
| 2005/0273331 | A1 | 12/2005 | Lu | |
| 2006/0281064 | A1 | 12/2006 | Sato et al. | |
| 2010/0082345 | A1 * | 4/2010 | Wang et al. | 704/260 |

FOREIGN PATENT DOCUMENTS

| | | |
|---|---|---|
| EP | 2000188 | 12/2008 |
| JP | 05-313686 | 11/1993 |
| JP | 07-044727 | 2/1995 |
| JP | 08123977 | 5/1996 |
| JP | 10-133852 | 5/1998 |
| JP | 2000-113216 | 4/2000 |
| JP | 2003-281567 | 10/2003 |
| JP | 3633399 | 1/2005 |

(Continued)

OTHER PUBLICATIONS

"The CMU Sphinx Group Open Source Speech Recognition Engines," CMUSphinx: The Carnegie Mellon Sphinx Project [online], Retrieved on Aug. 4, 2009, Retrieved from the Internet: <http:/ / cmusphinx.sourceforge.net/ html/cmusphinx.php>, page maintained by David Huggins—Daines (dhuggins+cmusphinx@cs.cmu.edu).

"What is HTK?," HTK Web-Site [online], Retrieved on Aug. 4, 2009, Retrieved from the Internet: <http:/ / htk.eng.cam.ac.uk/>, contact email (htk-mgr@eng.cam.ac.uk).

(Continued)

*Primary Examiner* — Qi Han
(74) *Attorney, Agent, or Firm* — NSIP Law

(57) ABSTRACT

An apparatus and method of creating a face character which corresponds to a voice of a user is provided. To create various facial expressions with fewer key models, a face character is divided in a plurality of areas and a voice sample is parameterized corresponding to pronunciation and emotion. If the user's voice is input, a face character image corresponding to divided face areas is synthesized using key models and data about parameters corresponding to the voice sample to synthesize an overall face character image using the synthesized face character image corresponding to the divided face areas.

18 Claims, 9 Drawing Sheets

FOREIGN PATENT DOCUMENTS

| | | |
|---|---|---|
| JP | 2005-038160 | 2/2005 |
| JP | 2005-346721 | 12/2005 |
| JP | 2006-330958 | 12/2006 |
| JP | 3949702 | 4/2007 |
| JP | 3950802 | 4/2007 |
| JP | 2007-058846 | 8/2007 |
| KR | 1020050060799 | 6/2005 |
| KR | 1020050108582 | 11/2005 |

OTHER PUBLICATIONS

Bongcheol Park, et al., "A Regional-based Facial Expression Cloning," CS/TR-2006-256, KAIST Department of Computer Science, Apr. 24, 2006, pp. 1-19.

Bongcheol Park, et al., "A Feature-Based Approach to Facial Expression Cloning," 2005, Computer Animation and Virtual Worlds, 16:pp. 291-303.

* cited by examiner

METHOD AND APPARATUS FOR CREATING FACE CHARACTER BASED ON VOICE

CROSS-REFERENCE TO RELATED APPLICATION(S)

This application claims the benefit under 35 U.S.C. §119 (a) of Korean Patent Application No. 10-2008-0100838, filed Oct. 14, 2008, the disclosure of which is incorporated by reference in its entirety for all purposes.

BACKGROUND

1. Field

The following description relates to technology to create a face character and, more particularly, to an apparatus and method of creating a face character which corresponds to a voice of a user.

2. Description of the Related Art

Modern-day animation (e.g., animation used in computer games, animated motion pictures, computer-generated advertisements, real-time animation, and the like) focuses on various graphical aspects which enhance realism of animated characters, including generating and rendering realistic character faces with realistic expressions. Realistic face animation is a challenge which requires a great deal of time, effort, and superior technology. Recently, services are in great demand which provide lip-sync animation using a human character in an interactive system. Accordingly, lip-sync techniques are being researched to graphically transmit voice data (i.e., voice data is data generated by a user speaking, singing, and the like) by recognizing the voice data and shaping a face of an animated character's mouth to correspond to the voice data. However, to successfully synchronize the animated character's face to the voice data requires large amounts of data to be stored and processed by a computer.

SUMMARY

In one general aspect, an apparatus to create a face character based on a voice of a user includes a preprocessor configured to divide a face character image in a plurality of areas using multiple key models corresponding to the face character image, and to extract data about at least one parameter to recognize pronunciation and emotion from an analyzed voice sample, and a face character creator configured to extract data about at least one parameter from input voice in frame units, and to synthesize in frame units the face character image corresponding to each divided face character image area based on the data about at least one parameter.

The face character creator may calculate a mixed weight to determine a mixed ratio of the multiple key models using the data about at least one parameter.

The multiple key models may include key models corresponding to pronunciations of vowels and consonants and key models corresponding to emotions.

The preprocessor may divide the face character image using data modeled in a spring-mass network having masses corresponding to vertices of the face character image and springs corresponding to edges of the face character image.

The preprocessor may select feature points having a spring variation more than a predetermined threshold in springs between a mass and neighboring masses with respect to a reference model corresponding to each of the key models, measure coherency in organic motion of the feature points to form groups of the feature points, and divide the vertices by grouping the remaining masses not selected as the feature points into the feature point groups.

In response to creating the parameters corresponding to the user's voice, the preprocessor may represent parameters corresponding to each vowel on a three formant parameter space from the voice sample, create consonant templates to identify each consonant from the voice sample, and set space areas corresponding to each emotion on an emotion parameter space to represent parameters corresponding to the analyzed pitch, intensity and tempo of the voice sample.

The face character creator may calculate weight of each vowel key model based on a distance between a position of a vowel parameter extracted from the input voice frame and a position of each vowel parameter extracted from the voice sample on the formant parameter space, determine a consonant key model through pattern matching between the consonant template extracted from the input voice frame and the consonant templates of the voice sample, and calculate weight of each emotion key model based on a distance between a position of an emotion parameter extracted from the input voice frame and the emotion area on the emotion parameter space.

The face character creator may synthesize a lower face area by applying the weight of each vowel key model to displacement of vertices of each vowel key model with respect to a reference key model or using the selected consonant key models, and synthesize an upper face area by applying the weight of each emotion key model to displacement of vertices of each emotion key model with respect to a reference key model.

The face character creator may create a face character image corresponding to input voice in frame units by synthesizing an upper face area and a lower face area.

In another general aspect, a method of creating a face character based on voice includes dividing a face character image in a plurality of areas using multiple key models corresponding to the face character image, extracting data about at least one parameter for recognizing pronunciation and emotion from an analyzed voice sample, in response to a voice being input, extracting data about at least one parameter from voice in frame units, and synthesizing in frame units the face character image corresponding to each divided face character image area based on the data about at least one parameter.

The synthesizing may include calculating a mixed weight to determine a mixed ratio of the multiple key models using the data about at least one parameter.

The multiple key models may include key models corresponding to pronunciations of vowels and consonants and key models corresponding to emotions.

The dividing may include using data modeled in a spring-mass network having masses corresponding to vertices of the face character image and springs corresponding to edges of the face character image.

The dividing may include selecting feature points having a spring variation more than a predetermined threshold in springs between a mass and neighboring masses with respect to a reference model corresponding to each of the key models, measuring coherency in organic motion of the feature points to form groups of the feature points, and dividing the vertices by grouping the remaining masses not selected as the feature points into the feature point groups.

The extracting of the data about the at least one parameter to recognize pronunciation and emotion from an analyzed voice sample may include representing parameters corresponding to each vowel on a three formant parameter space from the voice sample, creating consonant templates to identify each consonant from the voice sample, and setting space areas corresponding to each emotion on an emotion parameter space to represent parameters corresponding to analyzed pitch, intensity and tempo of the voice sample.

The synthesizing may include calculating weight of each vowel key model based on a distance between a position of a vowel parameter extracted from the input voice frame and a position of each vowel parameter extracted from the voice sample on the formant parameter space, determining a consonant key model through pattern matching between the consonant template extracted from the input voice frame and the consonant templates of the voice sample, and calculating weight of each emotion key model based on a distance between a position of an emotion parameter extracted from the input voice frame and the emotion area on the emotion parameter space.

The synthesizing may include synthesizing a lower face area by applying the weight of each vowel key model to displacement of vertices of each vowel key model with respect to a reference key model or using the selected consonant key models, and synthesizing an upper face area by applying the weight of each emotion key model to displacement of vertices of each emotion key model with respect to a reference key model.

The method may further include creating a face character image corresponding to input voice in frame units by synthesizing an upper face area and a lower face area.

Other features and aspects will be apparent from the following description, the drawings, and the claims.

BRIEF DESCRIPTION OF THE DRAWINGS

Throughout the drawings and the detailed description, unless otherwise described, the same drawing reference numbers refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses and/or systems described herein. Accordingly, various changes, modifications, and equivalents of the systems, apparatuses, and/or methods described herein will be suggested to those of ordinary skill in the art. Also, descriptions of well-known functions and constructions may be omitted for increased clarity and conciseness.

Figure 1:
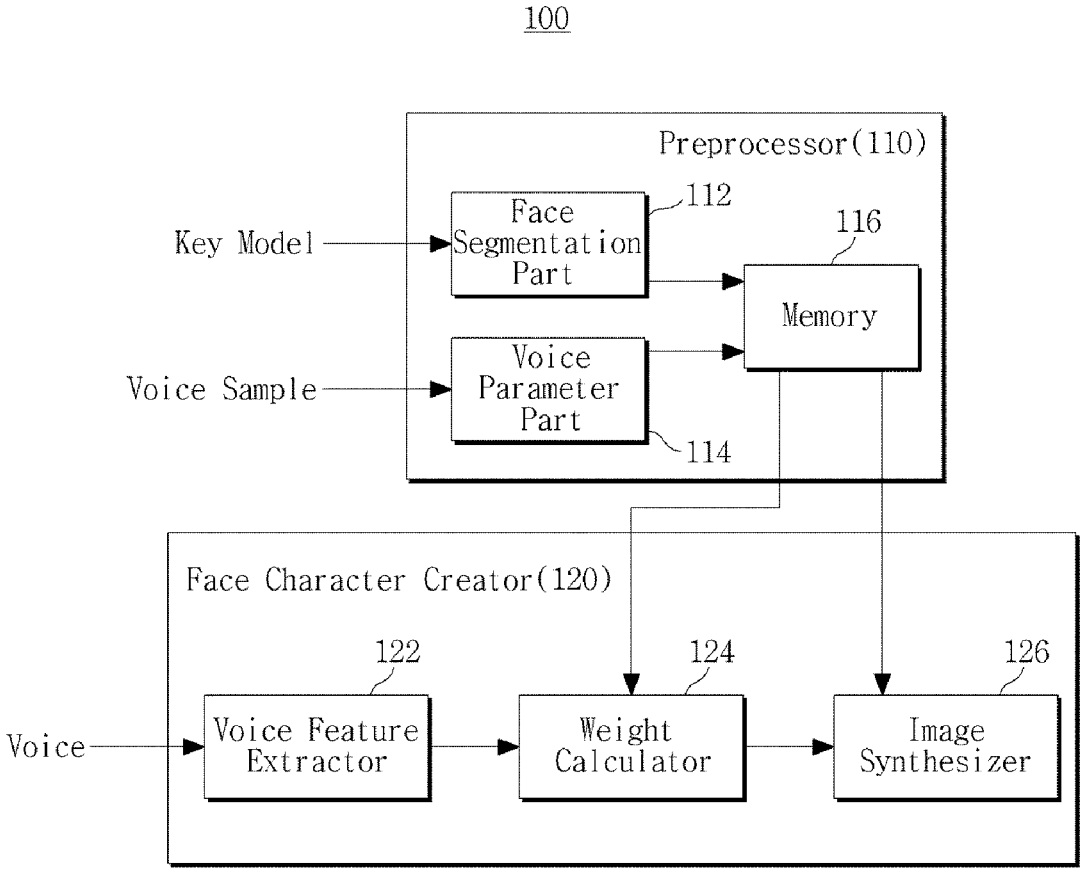
FIG. 1 is a block diagram illustrating an exemplary apparatus to create a face character based on a user's voice.

FIG. 1 illustrates an exemplary apparatus 100 to create a face character based on a user's voice.

The apparatus 100 to create a face character based on a voice includes a preprocessor 110 and a face character creator 120.

The preprocessor 110 receives key models corresponding to a character's facial expressions and a user's voice sample, and generates reference data to allow the face character creator 120 to create a face character based on the user's voice sample. The face character creator 120 divides the user's input voice into voice samples in predetermined frame units, extracts parameter data (or feature values) from the voice samples, and synthesizes a face character corresponding to the voice in frame units using the extracted parameter data and the reference data created by the preprocessor 110.

The preprocessor 110 may include a face segmentation part 112, a voice parameter part 114, and a memory 116.

The face segmentation part 112 divides a face character image in a predetermined number of areas using multiple key models corresponding to the face character image to create various expressions with a few key models. The voice parameter part 114 divides a user's voice into voice samples in frame units, analyzes the voice samples in frame units, and extracts data about at least one parameter to recognize pronunciations and emotions. That is, the parameters corresponding to the voice samples may be obtained with respect to pronunciations and emotions.

The reference data may include data about the divided face character image and data obtained from the parameters for the voice samples. The reference data may be stored in the memory 116. The preprocessor 110 may provide reference data about a smooth motion of hair, pupils' direction, and blinking eyes.

Face segmentation will be described with reference to FIGS. 2A through 5.

Face segmentation may include feature point extraction, feature point grouping, and division of vertices. A face character image may be modeled in a three-dimensional mesh model. Multiple key models corresponding to a face character image which are input to the face segmentation part 112 may include pronunciation-based key models corresponding to consonants and vowels and emotion-based key models corresponding to various emotions.

Figure 2A:
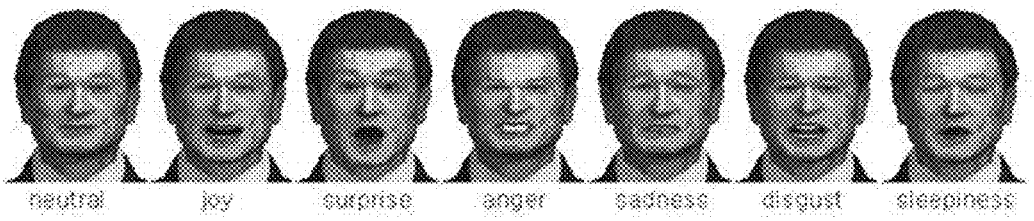
FIGS. 2A and 2B are series of character diagrams illustrating exemplary key models of pronunciations and emotions.
Figure 2B:
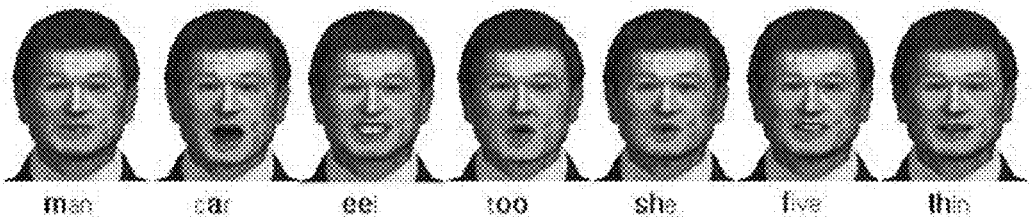

FIGS. 2A and 2B illustrate exemplary key models corresponding to pronunciations and emotions.

FIG. 2A illustrates exemplary key models corresponding to emotions, such as 'neutral,' 'joy,' 'surprise,' 'anger,' 'sadness,' 'disgust,' and 'sleepiness.' FIG. 2B illustrates exemplary key models corresponding to pronunciations of consonants, such as 'm,' 'sh,' 'f,' and 'th,' and of vowels, such as 'a.' 'e,' and 'o.' Other exemplary key models may be created corresponding to other pronunciations and emotions.

A face character image may be formed in a spring-mass network model of a triangle mesh. In this case, vertices which form a face may be considered masses, and edges of a triangle, i.e., lines connecting the vertices to each other, may be considered springs. The individual vertices (or masses) may be indexed and the face character image may be modeled with vertices and edges (or springs) having, for example, 600 indices.

Each of the key models may be modeled with the same number of springs and masses. Accordingly, masses have different positions depending on facial expressions and springs thus have different lengths with respect to the masses. Hence, each key model representing a different emotion with respect to a key model corresponding to a neutral face may have data containing a variation $\Delta x$ in a spring length x with respect to each mass and a variation in energy ($E=\Delta x^2/2$) of each mass.

When feature points are selected from masses forming key models corresponding to face segmentation, variations in spring lengths at corresponding masses of different key models with respect to masses of a key model corresponding to a neutral face are measured. In this case, a mass having a greater variation in spring than neighboring masses may be selected as a feature point. For example, when three springs are connected to a single mass, a variation in spring may be an average of variations in the three springs.

Figure 3:
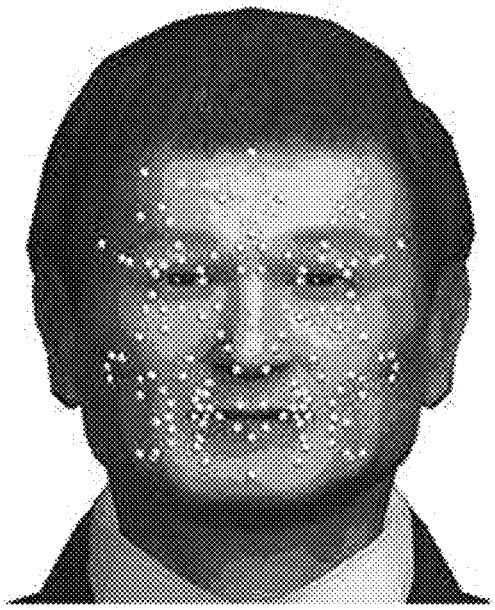
FIG. 3 is a character diagram illustrating an example of extracted feature points.

With reference to FIG. 1, when a face character image is represented with a spring-mass network, the face segmentation part 112 may select feature points having a variation in spring more than a predetermined threshold between masses and neighboring masses with respect to a reference model (e.g., a key model corresponding to a neutral face). FIG. 3 illustrates an example of extracted feature points.

The face segmentation part 112 may measure coherency in organic motion of the feature points and form groups of feature points.

The feature points may be grouped depending on the coherency in organic motion of the extracted feature points. The coherency in organic motion may be measured with similarities in magnitude and direction of displacements of feature points which are measured on each key model, and a geometric adjacency to a key model corresponding to a neutral face. An undirected graph may be obtained from quantized coherency in organic motion between the feature points. Nodes of the undirected graph indicate feature points and edges of the undirected graph indicate organic motion.

Figure 4:
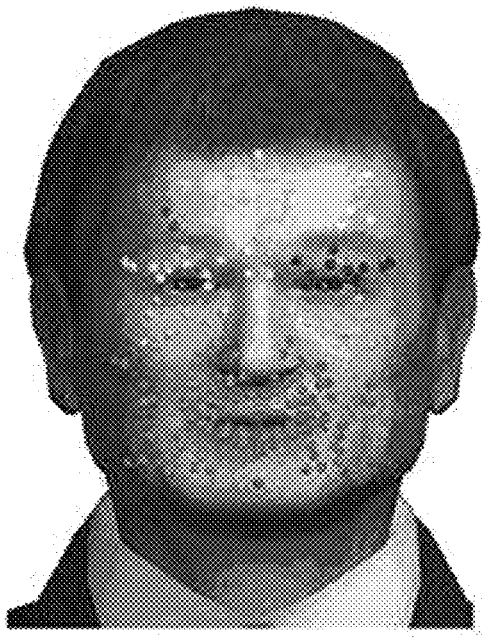
FIG. 4 is a character diagram illustrating a plurality of exemplary groups each including feature points.

A coherency in organic motion less than a predetermined threshold is considered not organic and a corresponding edge is deleted accordingly. Nodes of a graph may be grouped using a connected component analysis technique. As a result, extracted feature points may be automatically grouped in groups. FIG. 4 illustrates exemplary groups of feature points.

The face segmentation part 112 may group the remaining masses (vertices) which are not selected as the feature points into groups of feature points. Here, the face segmentation part 112 may measure coherency in organic motion between the feature points of each group and the non-selected masses.

Figure 5:
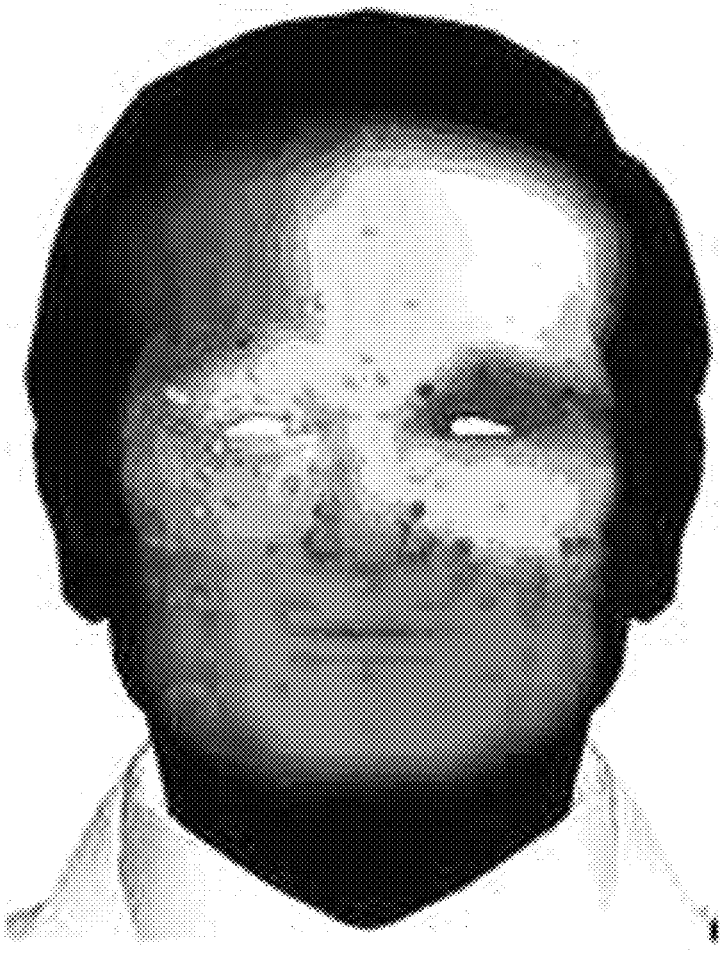
FIG. 5 is a character diagram illustrating an example of segmented vertices.

A method of measuring coherency in organic motion may be performed similarly to the above-mentioned method of grouping feature points. The coherency in organic motion between the feature point groups and the non-selected masses may be determined by an average of coherencies in organic motion between each feature point of each feature point group and the non-selected masses. If a coherency in organic motion between a non-selected mass and a predetermined feature point group exceeds a predetermined threshold, the mass belongs to the feature point group. Accordingly, a single mass may belong to several feature point groups. FIG. 5 illustrates an example of vertices thus segmented in several feature point groups.

If masses (or vertices) corresponding to modeling a face character image are thus grouped in a predetermined number of groups, the face character image may be segmented into groups of face character sub-images. The divided areas of a face character image and data about the divided areas of a face character image are applied to each key model and used to synthesize each key model in each of the divided areas.

Exemplary face segmentation will be described with reference to FIGS. 6 through 8.

Even during a phone conversation, voice tonalities and emotions may be conveyed orally from a speaker to a listener in order to convey to the listener the speaker's mood or emotional state. That is, a voice signal includes data about pronunciation and emotion. For example, a voice signal may be represented with parameters as illustrated in FIG. 6.

Figure 6:
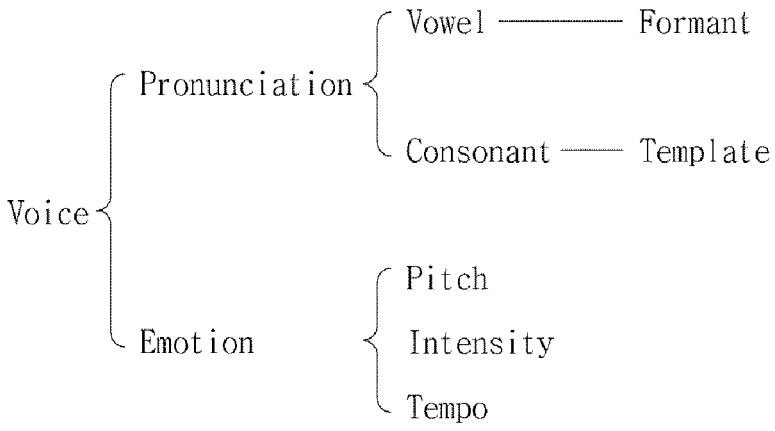
FIG. 6 is a diagram illustrating an exemplary hierarchy of parameters corresponding to a voice.

FIG. 6 illustrates an exemplary hierarchy of parameters corresponding to a voice.

Pronunciation may be divided into vowels and consonants. Vowels may be parameterized with resonance bands (formant). Consonants may be parameterized with specific templates. Emotion may be parameterized with a three-dimensional vector composed of pitch, intensity, and tempo of voice.

It is believed that a feature of a voice signal may not change during a time period as short as 20 milliseconds. Accordingly, a voice sample may be divided in frames of, for example, 20 milliseconds and parameters corresponding to pronunciation and emotion data may be obtained corresponding to each frame.

As described above, referring to FIG. 1, the voice parameter part 114 may divide and analyze a voice sample in frame units and extracts data about at least one parameter used to recognize pronunciation and emotion. For example, a voice sample is divided in frame units and parameters indicating a feature or characteristic of the voice are measured.

The voice parameter part 114 may extract formant frequency, template, pitch, intensity, and tempo of a voice sample in each frame unit. As illustrated in FIG. 6, formant frequency and template may be used as parameters for pronunciation, and pitch, intensity and tempo may be used as parameters corresponding to an emotion. Consonants and vowels may be differentiated by the pitch. The formant frequency may be used as a parameter for a vowel, and the template may be used as a parameter corresponding to a consonant with a voice signal waveform corresponding to the consonant.

Figure 7:
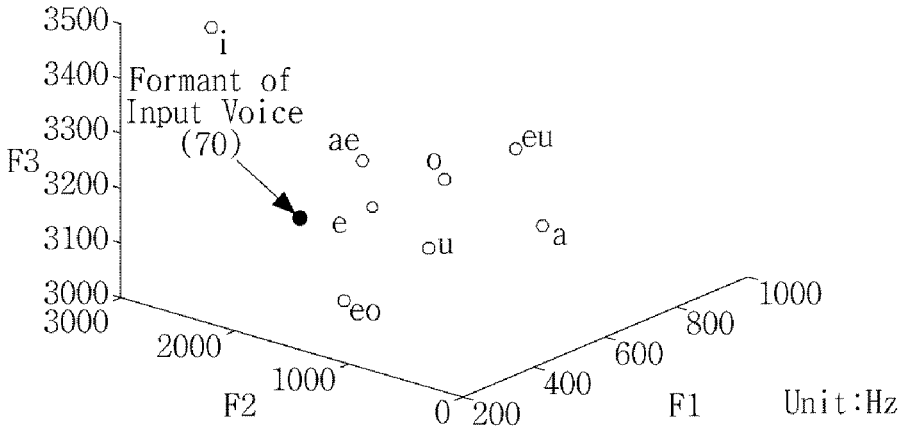
FIG. 7 is a diagram illustrating an exemplary parameter space corresponding to vowels.

FIG. 7 illustrates an exemplary vowel parameter space from parameterized vowels.

As described above, the voice parameter part 114 may extract formant frequency as a parameter to recognize each vowel. A vowel may include a fundamental formant frequency indicating frequencies per second of vocal cord and formant harmonic frequencies which are integer multiples of the fundamental formant frequency. Among the harmonic frequencies, three frequencies are generally stressed, which are referred to as first, second and third formants in ascending frequency order. The formant may vary depending on, for example, the size of an oral cavity.

To parameterize the vowels, the voice parameter part 114 may form a three-dimensional space with three axes of first, second and third formants and indicate a parameter of each vowel extracted from a voice sample on the formant parameter space, as illustrated in FIG. 7.

FIGS. 8A to 8D illustrate example templates corresponding to consonant parameters.

Figure 8A:
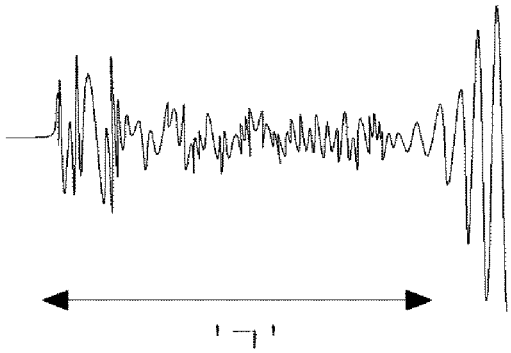
FIGS. 8A to 8D are diagrams illustrating exemplary templates corresponding to consonant parameters.
Figure 8B:
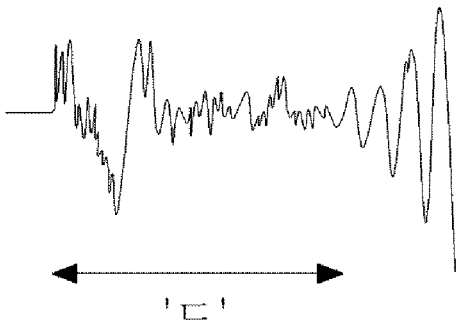
Figure 8C:
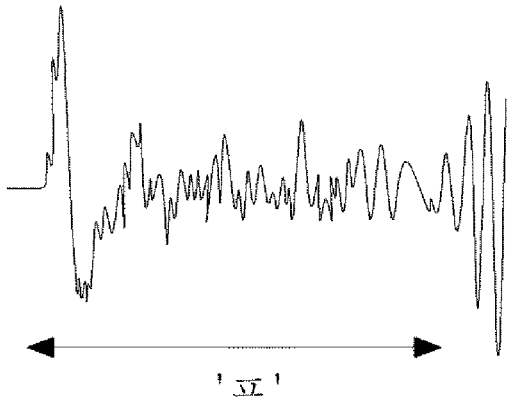
Figure 8D:
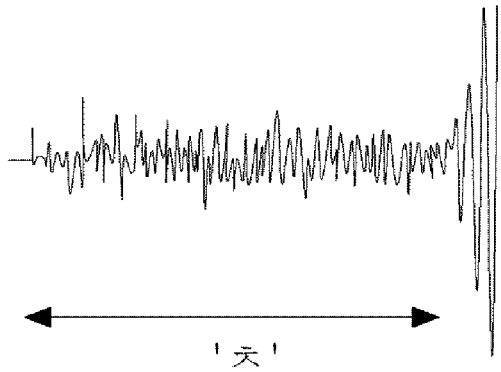

The voice parameter part 114 may create a consonant template to identify each consonant from a voice sample. FIG. 8A illustrates a template of a Korean consonant 'ㄱ,' FIG. 8B illustrates a template of a Korean consonant 'ㄷ,' FIG. 8C illustrates a template of a Korean consonant 'ㅍ,' and FIG. 8D illustrates a template of a Korean consonant 'ㅊ.'

Figure 9:
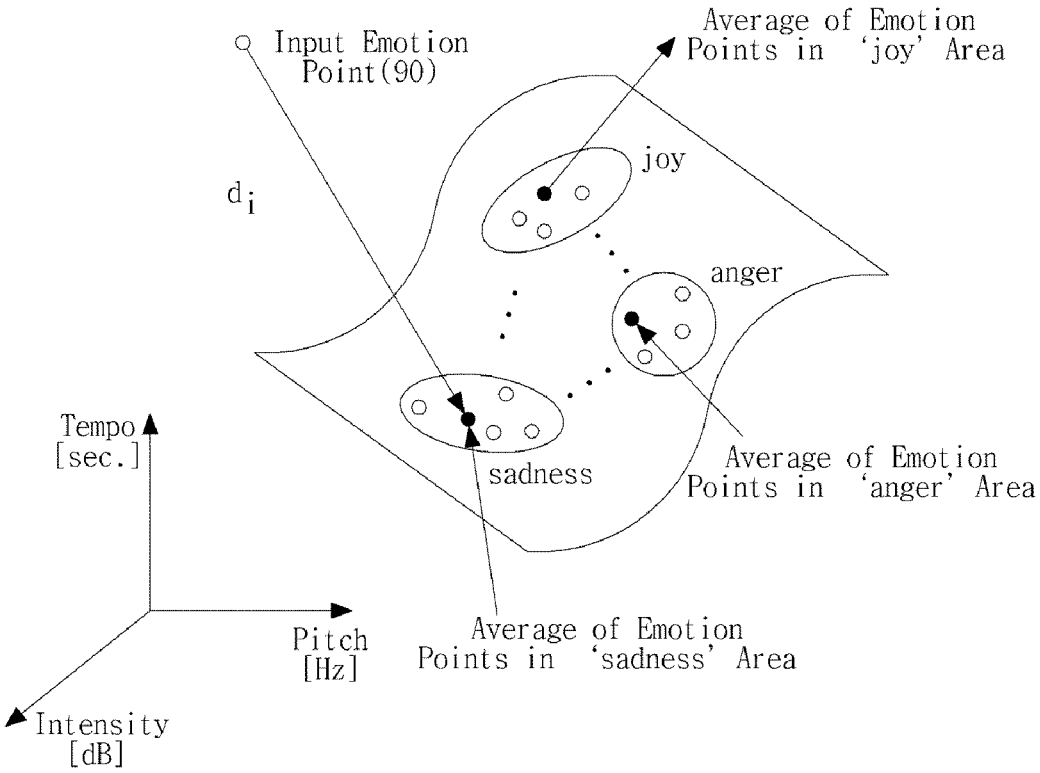
FIG. 9 is a diagram illustrating an exemplary parameter space corresponding to emotions which is used to determine weights of key models for emotions.

FIG. 9 illustrates an exemplary parameter space corresponding to emotions which is used to determine weights of key models corresponding to emotions.

As described above, the voice parameter part 114 may extract pitch, intensity and tempo as parameters corresponding to emotions. If parameters extracted from each voice frame, i.e., pitch, intensity and tempo, are placed on the parameter space with three axes of pitch, intensity and tempo, the pitch, intensity and tempo corresponding to each voice frame may be formed in a three-dimensional shape, e.g., three-dimensional curved surface, as illustrated in FIG. 9.

The voice parameter part 114 may analyze pitch, intensity and tempo of a voice sample in frame units and define an area specific to each emotion on an emotion parameter space to represent pitch, intensity and tempo parameters. That is, each emotion may have its unique area defined by the respective predetermined ranges of pitch, intensity and tempo. For example, a joy area may be defined to be an area of pitches more than a predetermined frequency, intensities between two decibel (dB) levels, and tempos more than a predetermined number of seconds.

A process of forming a face character from voice in the face character creator 120 will now be further described.

Referring back to FIG. 1, the face character creator 120 includes the voice feature extractor 122, the weight calculator 124 and the image synthesizer 126.

The voice feature extractor 122 receives a user's voice signal in real-time, divides the voice signal in frame units, and extracts data about each parameter extracted from the voice parameter part 114 as feature data. That is, the voice feature extractor 122 extracts formant frequency, template, pitch, intensity and tempo of the voice in frame units.

The weight calculator 124 refers to the parameter space formed by the preprocessor 110 to calculate weight of each key model corresponding to pronunciation and emotion. That is, the weight calculator 124 uses data about each parameter to calculate a mixed weight to determine a mixed ratio of key models.

The image synthesizer 126 creates a face character image, i.e., facial expression, corresponding to each voice frame by mixing the key models based on the mixed weight of each key model calculated by the weight calculator 124.

An exemplary method of calculating a mixed weight of each key model will now be further described.

The weight calculator 124 may use a formant parameter space illustrated in FIG. 7 as a parameter space to calculate a mixed weight of each vowel key model. The weight calculator 124 may calculate a mixed weight of each vowel key model based on a distance from a position of a vowel parameter extracted from an input voice frame on the formant parameter space to a position of each vowel parameter extracted from a voice sample.

For example, where an input voice frame is represented by an input voice formant 70 on a formant parameter space, a weight of each vowel key model may be determined by measuring three-dimensional Euclidean distances to each vowel, such as a, e, i, o and u, on the formant space illustrated in FIG. 7, and using the following inverted weight equation:

$$w_k=(d_k)^{-1}/\mathrm{sum}\{(d_i)^{-1}\} \quad \text{[Equation 1]}$$

where $w_k$ denotes a mixed weight of k-th vowel key model, $d_k$ denotes a distance between a position of a point indicating an input voice formant (e.g., a voice formant 70) on the formant space and a position of a point mapped to a k-th vowel parameter, and $d_i$ denotes a distance between a point indicating the input voice formant and a point indicating an i-th vowel parameter. Each vowel parameter is mapped to each vowel key model, and i indicates identification data assigned to each vowel parameter.

For consonant key models, by performing pattern matching between a consonant template extracted from an input voice frame and consonant templates of a voice sample, a consonant template having the best matched pattern may be selected.

The weight calculator 124 may calculate a weight of each emotion key model based on a distance between a position of an emotion parameter from an input voice frame on an emotion parameter space and each emotion area.

For instance, where an input voice frame is represented as an emotion point 90 of input voice on a formant parameter space, a weight of each emotion key model is calculated by measuring three-dimensional distances to each emotion area (e.g., joy, anger, sadness etc.) on the emotion parameter space as illustrated in FIG. 9 and using the following inverted weight equation:

$$w_k=(d_k)^{-1}/\mathrm{sum}\{(d_i)^{-1}\} \quad \text{[Equation 2]}$$

where $w_k$ denotes a mixed weight of k-th emotion key model, $d_k$ denotes a distance between an input emotion point (e.g., voice emotion point 90) and a k-th emotion point on the emotion parameter space, and $d_i$ denotes a distance between the input emotion point and an i-th emotion point. The emotion point may be an average of parameters of emotion points in the emotion parameter space. The emotion point is mapped to each emotion key model, and i indicates identification data assigned to each emotion space.

For a lower side of a face character image including mouth, the image synthesizer 126 may create key models corresponding to pronunciations by mixing weighted vowel key models (segmented face areas on a lower side of a face character of each key model) or using consonant key models. Regarding an upper side of the face character image including eyes, forehead, cheek, etc., the image synthesizer 126 may create key models corresponding to emotions by mixing weighted emotion key models. Accordingly, the image synthesizer 126 may synthesize the lower side of face character image by applying the weight of each vowel key model to displacement of vertices including each vowel key model with respect to a reference key model or using selected consonant key models. Furthermore, the image synthesizer 126 may synthesize the upper side of face character image by applying the weight of each emotion key model to displacement of vertices composing each emotion key model with respect to a reference key model. The image synthesizer 126 then may synthesize the upper and lower sides of face character image to create a face character image corresponding to input voice in frame units.

There is an index list of vertices in each segmented face area. For example, vertices around the mouth are {1, 4, 112, 233, . . . , 599}. Key models may be independently mixed in each area as follows:

$$v^i=\mathrm{sum}\{d^i_k\times w_k\} \quad \text{[Equation 3]}$$

where $v^i$ indicates a position of an i-th vertex, $d^i_k$ indicates displacement of an i-th vertex at a k-th key model (with respect to a key model corresponding to a neural face), and $w_k$ indicates a mixed weight of the k-th key model (vowel key model or emotion key model).

Accordingly, it is possible to create a face character image in frame units from voice input in real time using data about segmented face areas generated as a result of preprocessing and data generated from a parameterized voice sample. Hence, by applying the above-mentioned technique to, for example, online applications, it is possible to create natural three-dimensional face character images only from a user's voice and provide voice-driven face character animation online in real time.

Figure 10:
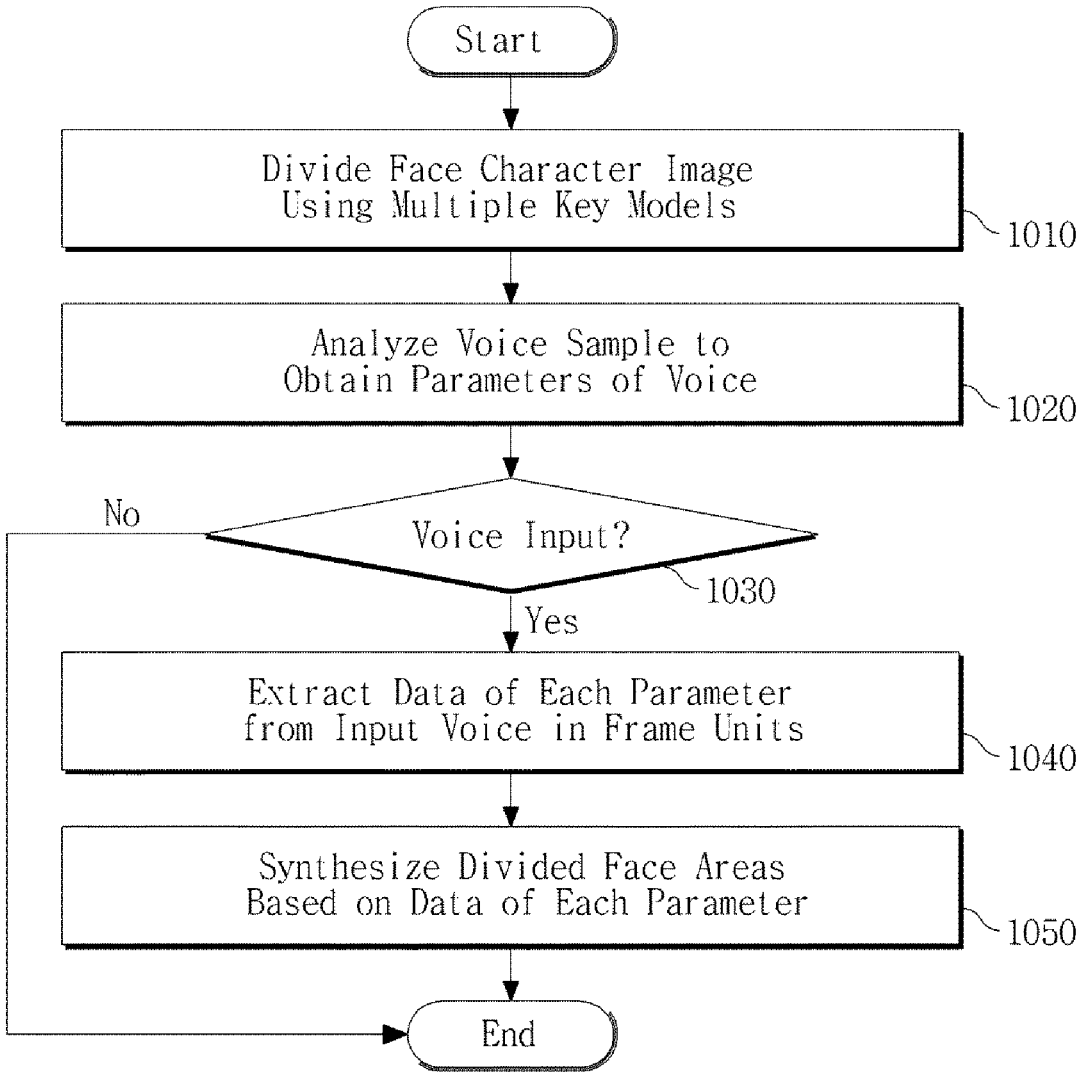
FIG. 10 is a flow chart illustrating an exemplary method of creating a face character based on voice.

FIG. 10 is a flow chart illustrating an exemplary method of creating a face character from voice.

In operation 1010, a face character image is segmented in a plurality of areas using multiple key models corresponding to the face character image.

In operation 1020, a voice parameter process is performed to analyze a voice sample and extract data about multiple parameters to recognize pronunciations and emotions.

If the voice is input in operation 1030, data about each parameter is extracted from the voice in frame units in operation 1040. Operation 1040 may further include calculating a mixed weight to determine a mixed ratio of a plurality of key models using the data about each parameter.

In operation 1050, a face character image is created to appropriately and accurately correspond to the voice by synthesizing the face character image corresponding to each of the segmented face areas based on the data about each parameter. The face character image may be created using mixed weights of the key models. Furthermore, the face character image may be created by synthesizing a lower side of the face character including mouth using key models for pronunciations and by synthesizing an upper side of the face character using key models corresponding to emotions.

The methods described above may be recorded, stored, or fixed in one or more computer-readable storage media that includes program instructions to be implemented by a computer to cause a processor to execute or perform the program instructions. The media may also include, alone or in combination with the program instructions, data files, data structures, and the like. Examples of computer-readable media include magnetic media, such as hard disks, floppy disks, and magnetic tape; optical media such as CD ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as produced by a compiler, and files containing higher level code that may be executed by the computer using an interpreter. The described hardware devices may be configured to act as one or more software modules in order to perform the operations and methods described above, or vice versa. In addition, a computer-readable storage medium may be distributed among computer systems connected through a network and computer-readable codes or program instructions may be stored and executed in a decentralized manner.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An apparatus to create a face character based on a voice of a user, comprising:

a preprocessor configured to divide a face character image in a plurality of areas using multiple key models corresponding to the face character image, and to extract data about at least one parameter to recognize pronunciation and emotion from an analyzed voice sample; and a face character creator configured to extract data about at least one parameter from an input voice in frame units, and to synthesize in frame units the face character image corresponding to each divided face character image area based on the data about at least one parameter extracted by the preprocessor.

2. The apparatus of claim 1, wherein the face character creator calculates a mixed weight to determine a mixed ratio of the multiple key models using the data about at least one parameter.

3. The apparatus of claim 1, wherein the multiple key models comprise key models corresponding to pronunciations of vowels and consonants and key models corresponding to emotions.

4. The apparatus of claim 1, wherein the preprocessor divides the face character image using data modeled in a spring-mass network having masses corresponding to vertices of the face character image and springs corresponding to edges of the face character image.

5. The apparatus of claim 4, wherein the preprocessor selects feature points having a spring variation more than a predetermined threshold in springs between a mass and neighboring masses with respect to a reference model corresponding to each of the key models, measures coherency in organic motion of the feature points to form groups of the feature points, and divides the vertices by grouping the remaining masses not selected as the feature points into the feature point groups.

6. The apparatus of claim 1, wherein in response to creating the parameters corresponding to the user's voice, the preprocessor represents parameters for each vowel on a three formant parameter space from the voice sample, creates consonant templates to identify each consonant from the voice sample, and sets space areas corresponding to each emotion on an emotion parameter space to represent parameters corresponding to the analyzed pitch, intensity and tempo of the voice sample.

7. The apparatus of claim 6, wherein the face character creator:

calculates weight of each vowel key model based on a distance between a position of a vowel parameter extracted from the input voice frame and a position of each vowel parameter extracted from the voice sample on the formant parameter space;

determines a consonant key model through pattern matching between the consonant template extracted from the input voice frame and the consonant templates of the voice sample; and calculates weight of each emotion key model based on a distance between a position of an emotion parameter extracted from the input voice frame and the emotion area on the emotion parameter space.

8. The apparatus of claim 7, wherein the face character creator:

synthesizes a lower face area by applying the weight of each vowel key model to displacement of vertices of each vowel key model with respect to a reference key model or using the selected consonant key models; and synthesizes an upper face area by applying the weight of each emotion key model to displacement of vertices of each emotion key model with respect to a reference key model.

9. The apparatus of claim 8, wherein the face character creator creates a face character image corresponding to input voice in frame units by synthesizing an upper face area and a lower face area.

10. A method of creating a face character based on voice, the method comprising:

dividing, via a preprocessor, a face character image in a plurality of areas using multiple key models corresponding to the face character image;

extracting, via a face character creator data about at least one parameter to recognize pronunciation and emotion from an analyzed voice sample;

in response to a voice being input, extracting, via the face character creator, data about at least one parameter from voice in frame units; and synthesizing in frame units, via the face character creator, the face character image corresponding to each divided face character image area based on the data about at least one parameter.

11. The method of claim 10, wherein the synthesizing comprises calculating a mixed weight to determine a mixed ratio of the multiple key models using the data about at least one parameter.

12. The method of claim 10, wherein the multiple key models comprise key models corresponding to pronunciations of vowels and consonants and key models corresponding to emotions.

13. The method of claim 12, wherein the dividing comprises using data modeled in a spring-mass network having masses corresponding to vertices of the face character image and springs corresponding to edges of the face character image.

14. The method of claim 13, wherein the dividing comprises:

selecting feature points having a spring variation more than a predetermined threshold in springs between a mass and neighboring masses with respect to a reference model corresponding to each of the key models;

measuring coherency in organic motion of the feature points to form groups of the feature points; and dividing the vertices by grouping the remaining masses not selected as the feature points into the feature point groups.

15. The method of claim 10, wherein the extracting of the data about the at least one parameter to recognize pronunciation and emotion from the analyzed voice sample comprises:

representing parameters corresponding to each vowel on a three formant parameter space from the voice sample;

creating consonant templates to identify each consonant from the voice sample; and setting space areas corresponding to each emotion on an emotion parameter space to represent parameters corresponding to analyzed pitch, intensity and tempo of the voice sample.

16. The method of claim 15, wherein the synthesizing comprises:

calculating weight of each vowel key model based on a distance between a position of a vowel parameter extracted from the input voice frame and a position of each vowel parameter extracted from the voice sample on the formant parameter space;

determining a consonant key model through pattern matching between the consonant template extracted from the input voice frame and the consonant templates of the voice sample; and calculating weight of each emotion key model based on a distance between a position of an emotion parameter extracted from the input voice frame and the emotion area on the emotion parameter space.

17. The method of claim 16, wherein the synthesizing comprises:

synthesizing a lower face area by applying the weight of each vowel key model to displacement of vertices of each vowel key model with respect to a reference key model or using the selected consonant key models; and synthesizing an upper face area by applying the weight of each emotion key model to displacement of vertices of each emotion key model with respect to a reference key model.

18. The method of claim 17, further comprising creating a face character image corresponding to input voice in frame units by synthesizing an upper face area and a lower face area.

* * * * *